US006320476B1

(12) United States Patent
Tsukahara

(10) Patent No.: US 6,320,476 B1
(45) Date of Patent: Nov. 20, 2001

(54) MILLIMETER-BAND SEMICONDUCTOR SWITCHING CIRCUIT

(75) Inventor: Yoshihiro Tsukahara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/416,525

(22) Filed: Oct. 12, 1999

(30) Foreign Application Priority Data

Apr. 8, 1999 (JP) ..... 11-101264

(51) Int. Cl.[7] ..... H01P 1/10
(52) U.S. Cl. ..... 333/104; 333/262
(58) Field of Search ..... 333/104, 253, 333/262; 257/276, 249, 401, 203, 522

(56) References Cited

U.S. PATENT DOCUMENTS 5,272,457 * 12/1993 Heckaman et al. ..... 333/262
6,020,613 * 2/2000 Udomoto et al. ..... 257/341

FOREIGN PATENT DOCUMENTS 6481501 3/1989 (JP) .
10284508 10/1998 (JP) .

* cited by examiner

*Primary Examiner*—Robert Pascal
*Assistant Examiner*—Kimberly E Glenn
(74) *Attorney, Agent, or Firm*—Leydig, Voit & MAyer, Ltd.

(57) ABSTRACT

A semiconductor switch includes parallel connected FETs, each FET having gate electrodes interleaved with first and second electrodes on a semiconductor substrate. An electrode interconnect connects, in a lengthwise direction of the first electrodes, mutually adjacent first electrodes. A further electrode interconnect connects second electrodes of the FETs in a direction intersecting the first electrode interconnect. A ground line connects to ground at least two of the second electrodes at the outside-most positions of the second electrodes.

17 Claims, 15 Drawing Sheets

MILLIMETER-BAND SEMICONDUCTOR SWITCHING CIRCUIT

BACKGROUND OF THE INVENTION 1. (Field of the Invention)

The present invention relates to a semiconductor switching circuit used in the millimeter-wave band.

2. (Description of Related Art)

Field effect transistors (FET) are typically used as a switching element for switching between transmitting and receiving signals in a communication, receiving, or transmission module used in microwave and millimeter-wave communications and radar systems.

FIG. 17A is a front view of a FET 600 used as a single-pole single-throw (SPST) switch in a typical semiconductor switch, and FIG. 17B is a sectional view taken along the line XVIIB–XVIIB' in FIG. 17A. Drain interconnect 601 and drain electrode 602 are connected together by means of a conductive air bridge 617 bridging source electrode 605 and gate electrode 612. Drain electrode 602 and drain electrode 603 are connected together by a conductive air bridge 618 bridging source electrode 606 and gate electrodes 613 and 614. Drain electrode 603 and drain interconnect 604 are connected together by a conductive air bridge 619 bridging source electrode 607 and gate electrodes 615. Source electrodes 605, 606, and 607 are connected to via hole 609 by way of a generally comb-shaped source interconnect 608. Gate electrodes 612, 613, 614, and 615 are interleaved with a gate current supply interconnect 616 between the above-noted source and drain electrodes. The drain interconnect 601 is connected to a transmission line 610 forming a part of an MMIC (Microwave and Millimeter-wave Integrated Circuit). Drain electrode path 604 is similarly connected to a transmission line 611 also forming another part of the MMIC.

FIG. 18 shows an equivalent circuit of the FET 600. Inductances 623 and 624 disposed in front and rear stages of the FET 600, respectively, have an inductance component L peculiar to the FET 600 as shown in FIG. 17A, and inductance 625 is an inductance component Ls of the via hole 609 shown on the left side of source electrodes 605, 606, and 607 in FIG. 17A.

Switching is accomplished by controlling the voltage (which is hereinafter referred to as "gate voltage Vg") applied to the gate electrodes, that is, to gate current supply interconnect 616, of FET 600. More specifically, FET 600 is on when gate voltage Vg is set to a level lower than or equal to a specific threshold value, such as when the gate voltage Vg is set to approximately 0 V, to thereby connect transmission line 610 to ground conductor 622. As a result, there is no signal flow to transmission line 611. When the gate voltage Vg exceeds the above-noted threshold value, FET 600 is off, signal flow from transmission line 610 to ground conductor 622 is interrupted, and signals thus flow from transmission line 610 to transmission line 611.

FIG. 19 is an equivalent circuit of FET 600 in the ON state. Resistor 626 is an ON resistance $R_{on}$. Impedance $Z_{on}$ of the FET observed at node B is expressed by the following equation:

$$Z_{on}=R_{on}+j2\pi f(2L+Ls).$$

As will be known from this equation, impedance $Z_{on}$ increases as the frequency f of the RF signal input increases. When impedance $Z_{on}$ reaches a particular high level, resistance division allows part of the signal that should flow from transmission line 610 to ground conductor 622 to leak to transmission line 611, and switching characteristics deteriorate, that is, signal loss increases and isolation deteriorates.

FIG. 20 is an equivalent circuit of FET 600 in the OFF state. Capacitance 627 is an OFF capacitance $C_{off}$. Impedance $Z_{off}$ of the FET observed at node B is expressed by the following equation:

$$Z_{off}=-j/2\pi fC_{off}+j2\pi f(2L+Ls)=-j[1-4\pi^2f^2C_{off}/(2L+Ls)]/(2\pi fC\text{off}).$$

As will be known from this equation, impedance $Z_{off}$ decreases as the frequency f of the RF signal increases. When impedance $Z_{off}$ reaches a particular low level, resistance division allows part of the signal that should flow from transmission line 610 to transmission line 611 to leak to ground conductor 622, and switching characteristics again deteriorate, that is, signal loss increases and isolation deteriorates.

FIG. 21 is a Smith chart showing impedance $Z_{on}$ and impedance $Z_{off}$, indicated by the black dots in the figure, at node B in FIG. 19 and FIG. 20 when an RF signal of frequency f=75 GHz is passed. As noted above, impedance $Z_{on}$ when in the ON state and impedance $Z_{off}$ in the OFF state are proportional to the frequency f of the RF signal. To improve switching characteristics with high frequency RF signals, particularly in the millimeter-wave band, inductances 623, 624, and 625, or more specifically the inductance L of the FET design and the inductance Ls of the via hole, must be suppressed to low levels.

SUMMARY OF THE INVENTION

An object of the present invention is therefore to provide an field effect transistor capable of exhibiting excellent switching characteristics such as a low loss and high isolation with respect to high frequency, particularly millimeter-wave RF signal, by suppressing the inductance component peculiar to the shape of the FET to a low level.

To achieve the above object, a millimeter-band semiconductor switching circuit according to the present invention comprises a field effect transistor (FET) as a switching element for the millimeter-band transmission line disposed between the millimeter-band transmission line and ground. This semiconductor switching circuit comprises a generally comb-shaped gate electrode having a plurality of gate electrode prongs and connected to a current supply path; a first electrode and a second electrode interleaved in alternating sequence with the plurality of gate electrode prongs with a specific interval therebetween; a first electrode interconnect interconnecting the plurality of first electrodes at each lengthwise end of the first electrodes; a second electrode interconnect for connecting adjacent second electrodes by means of an air bridge; and a ground line for connecting to ground the first electrode interconnect, or two second electrodes located at both ends in the connection direction and connected by way of the second electrode interconnect. A transmission line is connected to the first electrode interconnect, or the second electrodes located at both ends in the connection direction and connected by way of the second electrode interconnect, that is not connected to the ground line.

Accordingly, it is possible to reduce the inductance component between an electrode and the ground layer to thereby improve the switching characteristic, as compared with the device in which a first electrode interconnect disposed at both ends of a first electrode, or one of two second electrodes that are connected by means of a second electrode interconnect and are disposed at both ends in the connection direction, is connected to a ground layer of a semiconductor substrate. In addition, the transmission line can be connected in the same wiring pattern, thereby increasing the freedom of design incorporating the semiconductor switching circuit.

The first and second electrodes can be the drain and source electrodes, or the source and drain electrodes, respectively.

It is to be noted that the ground line can connect to ground by way of a via hole, the first electrode interconnect or two second electrodes located at both ends in the connection direction and interconnected by a second electrode interconnect. Alternatively, the ground line can directly connect to a ground plate the first electrode interconnect or two second electrodes located at both ends in the connection direction and interconnected by a second electrode interconnect.

The first electrode interconnect and second electrode interconnect can be further mutually connected by means of a resonance circuit having a specific reactance.

A further aspect of the present invention relates to a millimeter-band semiconductor switching circuit having a field effect transistor disposed as a switching element between ground and a millimeter-band transmission line. This semiconductor switching circuit comprises a generally comb-shaped gate electrode having a plurality of gate electrode prongs connected to a current supply line; a first electrode and a second electrode having a plurality of mutually interleaved electrode prongs with a specific gap to each of the plurality of gate electrode prongs; a ground line for directly connecting to ground each of the plurality of first electrode prongs; and an electrode interconnect for interconnecting the plurality of second electrodes, and connecting to the transmission line at two opposing points.

The electrode interconnect further preferably connects to each second electrode in the lengthwise direction thereof, and has a transmission line connecting terminal at both sides in the lengthwise direction of the second electrodes.

Alternatively, the electrode interconnect may connect adjacent second electrodes by way of an air bridge in the widthwise direction of the second electrodes, and has a transmission line connecting terminal at both sides in the widthwise direction of the second electrodes.

Again alternatively, the electrode interconnect may be interleaved with the plurality of second electrodes, and has a transmission line connecting terminal on both sides in the short direction of the second electrodes.

BRIEF DESCRIPTION OF THE DRAWINGS

Other objects and attainments together with a fuller understanding of the invention will become apparent and appreciated by referring to the following description and claims taken in conjunction with the accompanying drawings, in which:

DESCRIPTION OF THE PREFERRED EMBODIMENTS

The preferred embodiments of the present invention will be described below with reference to the accompanying drawings.

Embodiment 1

An FET 1 according to a first preferred embodiment of the present invention as shown in FIG. 1 functions as a single-pole, single-throw (SPST) semiconductor switch. As will be known from FIG. 1, this FET 1 comprises a generally comb-shaped gate electrode having a plurality of gate electrode prongs and connected to a current supply interconnect; and a source electrode array comprising a plurality of source electrodes interconnected by way of respective air bridges. Of the plurality of source electrodes, two source electrodes facing the ends of the source electrode array are connected to at least one via hole.

This configuration facilitates shortening the distance from each source electrode to the via hole, and can thereby reduce the inductance component added by the via hole when the FET is switched on and off. An increase in the impedance $Z_{on}$ when the FET is switched on, and a decrease in impedance $Z_{off}$ when the FET is switched off, can thus be suppressed and switching characteristics improved consequently.

Figure 1B:
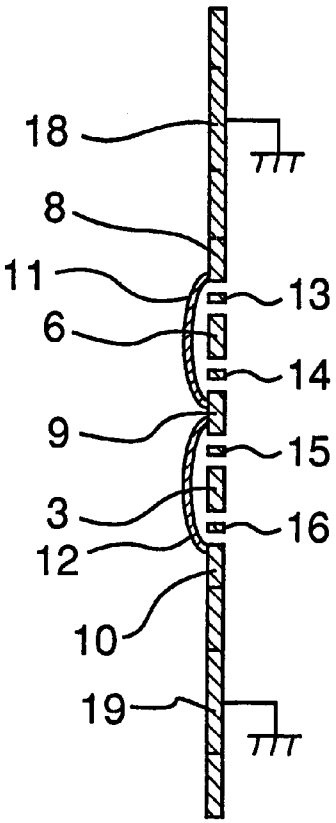
FIG. 1B is a section view taken along the line IB–IB' in FIG. 1A.
Figure 1A:
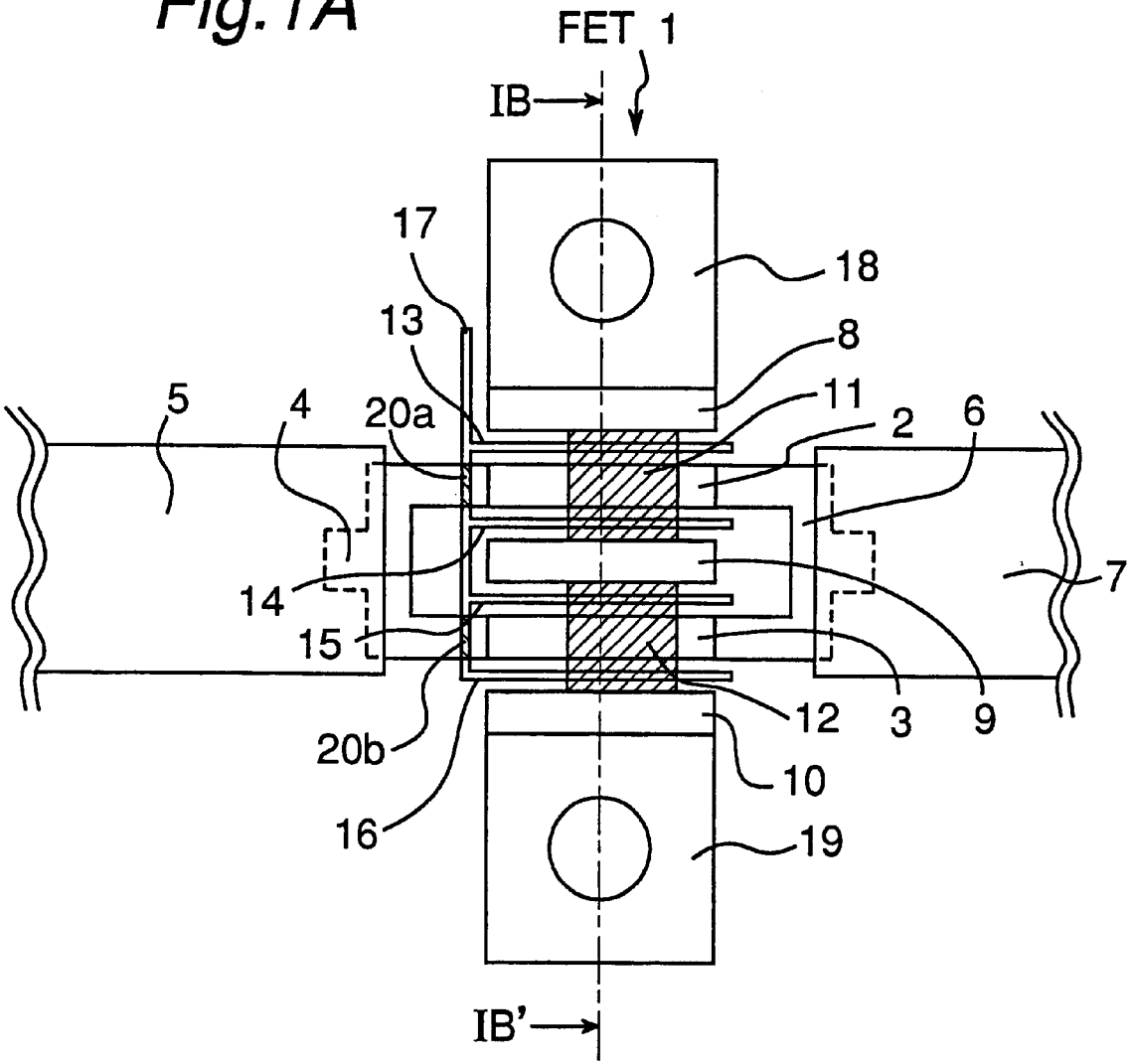
FIG. 1A is a typical plan view of a FET according to a first preferred embodiment of the present invention.

FIG. 1A is a plan view of the FET 1 formed on a semiconductor substrate (not shown) having a ground layer, and FIG. 1B is a section view through line IB–IB' in FIG. 1A. Drain electrode prongs 2 and 3 are disposed substantially parallel to the comb-shaped gate electrode prongs 13, 14, 15, and 16, and are connected to drain interconnects 4 and 6, which are disposed at opposite ends of the drain prongs. The gate electrode prongs 13, 14, 15, and 16 are connected to gate current supply interconnect 17. Note that drain interconnect 4 and gate current supply interconnect 17 are isolated by an insulator at points 20*a* and 20*b* where they cross.

As shown in FIG. 1B, source electrode 8 and source electrode 9 are connected by a conductive air bridge 11 bridging gate electrode prongs 13 and 14 and drain electrode prong 2. Source electrode 9 and source electrode 10 are connected by a conductive air bridge 12 bridging gate electrode prongs 15 and 16 and drain electrode prong 3. Source electrodes 8 and 10 are each connected to a via hole 18 and 19, respectively, which are directly connected to a ground layer of a semiconductor substrate (not shown).

It is to be noted that the number of via holes to which the source electrodes 8 and 10 are connected may be at least one and is preferably more than one.

Figure 2:
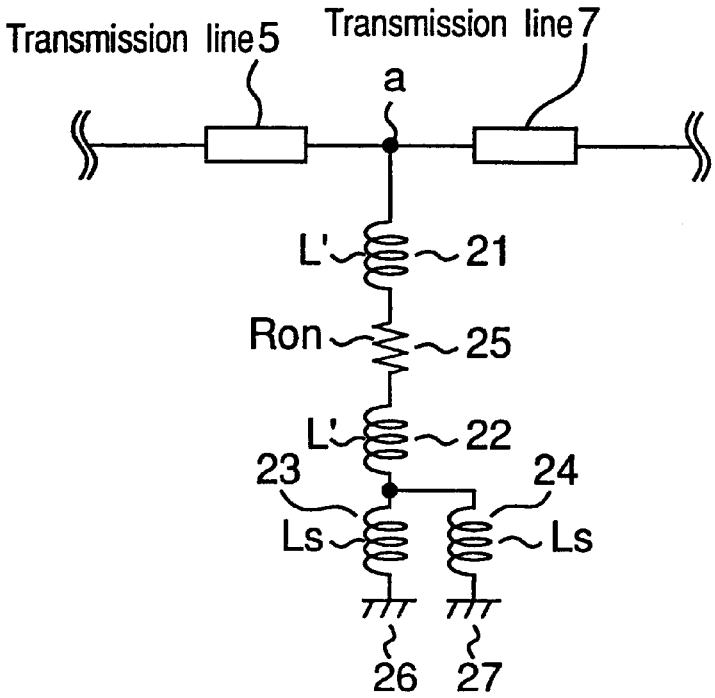
FIG. 2 is an equivalent circuit of the FET in FIG. 1A when the FET is in an ON state.

FIG. 2 is an equivalent circuit of the above-described FET 1 when used as a SPST switch in an MMIC device, and a specific gate voltage Vg is applied to turn the FET 1 on. Inductances 21 and 22 in FIG. 2 are the inductance component L' of the FET 1 design. Inductances 23 and 24 represent respective inductance components Ls of the via holes 18 and 19. Resistance 25 is the source-drain resistance $R_{on}$ in FET 1. When resistance $R_{on}$ is several ohms, the impedance $Z_{on}$ of FET 1 observed at node a can be approximated by the following equation (1):

$$Z_{on}=R_{on}+j2\pi f(2L'+Ls_{sum}) \quad (1)$$

where inductance component L' is the inductance resulting from the construction of switching element 1, and inductance $Ls_{sum}$ is the sum of the inductance components Ls of the disposed two or more via holes.

In the equivalent circuit shown in FIG. 2, the number of parallel connected inductance components Ls (inductances 23 and 24) is proportional to the number of via holes connected to the source electrode. In this exemplary embodiment, if the inductance component of one via hole disposed perpendicular to the transmission line on one side is $Ls_0$, and the number of via holes connected to source electrodes 8 and 10 on both ends is n, the total $Ls_{sum}$ of the inductance Ls of each of the one or more via holes connected on both sides perpendicularly to the transmission line can be expressed by the following equation (2):

$$Ls_0/2>=Ls_{sum}>Ls/n \quad (2)$$

As will be known from equation (1), the impedance $Z_{on}$ observed from node a in FIG. 2 increases in conjunction with an increase in the frequency f of the supplied RF signal. As the impedance $Z_{on}$ increases, part of the RF signal flowing on transmission line 5 leaks and flows to transmission line 7 due to resistance dividing, even though all of the RF signal should flow to ground conductors 26 and 27. However, the total inductance $Ls_{sum}$ of the via holes can be reduced to less than half as shown in equation (2) as a result of connecting the source electrodes at each end to one or more via holes as described above.

It is therefore possible to significantly suppress an increase in impedance $Z_{on}$ in conjunction with an increase in the frequency of the RF signal, to thereby significantly improve the switching characteristics, specifically reduce signal loss and increase isolation, of the FET 1 when the latter is switched on.

Figure 3:
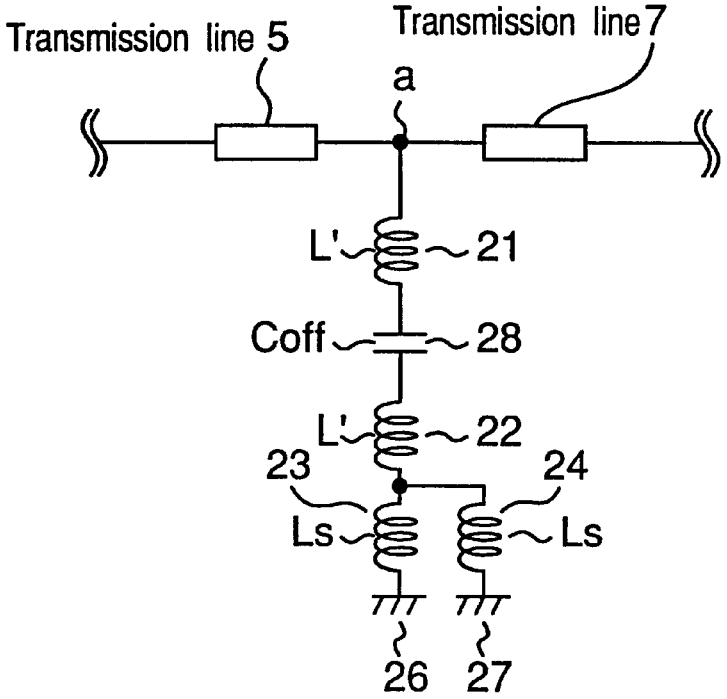
FIG. 3 is an equivalent circuit of the FET in FIG. 1A when the FET is in an OFF state.

FIG. 3 is an equivalent circuit of the above-described FET 1 when used as a SPST switch in an MMIC device, and the voltage supplied to the gate current supply interconnect 17 is switched to a level below the drain current pinch-off voltage Vp of the FET 1 to turn the FET 1 off. Capacitance $C_{off}$ represents a source-drain capacitance in FET 1. Impedance $Z_{off}$ of FET 1 observed at node a is as shown by the following equation (3).

$$Z\text{off}=-j/(2\pi f\cdot C_{off})+j2\pi f(2L+Ls_{sum})=-j\{1-4\pi^2 f^2\cdot C_{off}(2L+Ls_{sum})\}/(2\pi f\cdot C_{off}) \quad (3)$$

As will be known from equation (3), the impedance $Z_{off}$ observed from node a in FIG. 3 decreases in conjunction with an increase in the frequency f of the supplied RF signal. However, the total inductance $Ls_{sum}$ of the via holes can be reduced to less than half as shown in equation (2) as a result of connecting two or more via holes to the source electrodes as described above.

It is therefore possible to significantly suppress an increase in impedance $Z_{off}$ in conjunction with an increase in the frequency of the RF signal, to thereby significantly improve the switching characteristics, specifically reduce signal loss and increase isolation, of the FET 1 when the latter is switched off.

Figure 4:
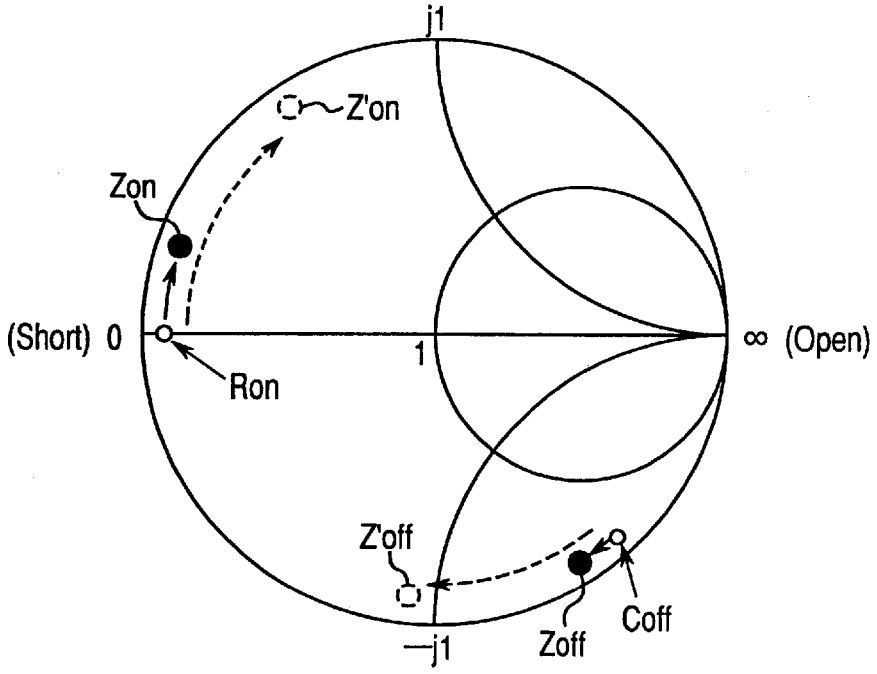
FIG. 4 is a Smith chart illustrating performance of the FET of FIG. 1A.
Figure 5:
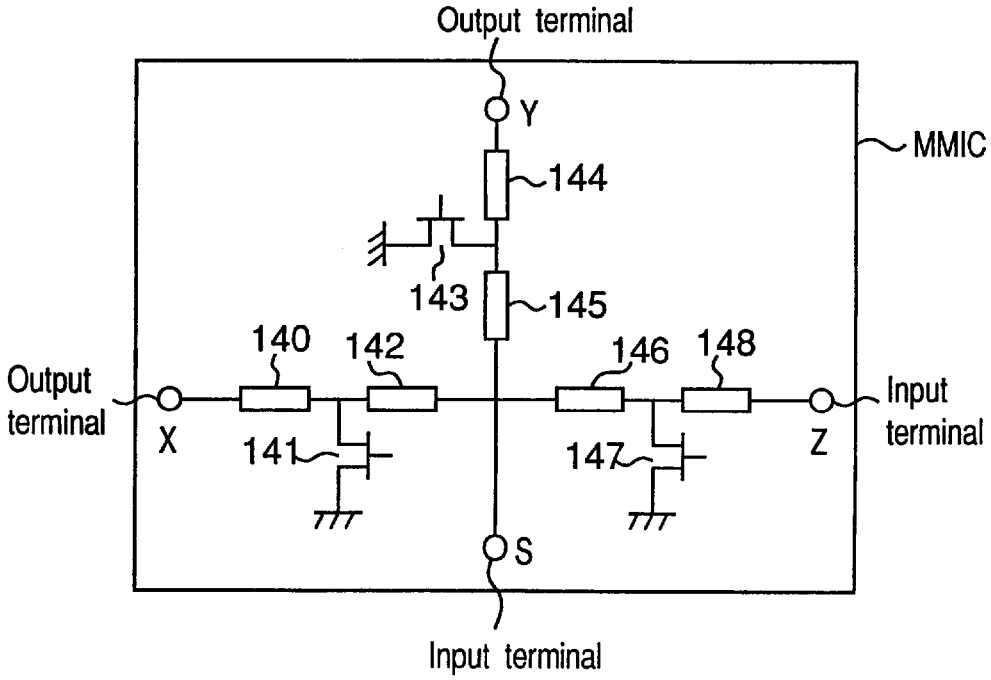
FIG. 5 is a schematic diagram of a 1-input, 3-output circuit using the FET.

FIG. 4 is a Smith chart showing impedance $Z_{on}$ and impedance $Z_{off}$, indicated by the black dots in the figure, as observed at node a in FIG. 2 and FIG. 3 when an RF signal of frequency f=75 GHz is passed. The impedance $Z_{on}'$ and impedance $Z_{off}'$ when there is only one via hole, such as only via hole 18, connected to only one of the two end source electrodes, such as source electrode 8, are indicated by the dotted line in FIG. 4. The impedance $Z_{on}$ and impedance $Z_{off}$ when a via hole 18 is connected to source electrode 8 and another via hole 19 is connected to source electrode 10 as in this exemplary embodiment of the present invention are indicated by the solid lines in FIG. 4.

As will be confirmed from the figure, an increase in impedance $Z_{on}$ and a decrease in impedance $Z_{off}$ can be efficiently suppressed by disposing a via hole to each of the source electrodes on the end.

It is to be noted that the coupling capacitance of the RF signal and via hole is made symmetrical and RF characteristics can thereby be stabilized, if via holes 18 and 19 are disposed symmetrically with each other and perpendicular to the direction in which the RF signal travels through the transmission line.

It is to be further noted that FET 1 has transmission lines 5 and 7 connected to the same line with two via holes 18 and 19 symmetrically disposed to the transmission line such that the via holes 18 and 19 intersect the transmission line. This configuration facilitates the design of FET 1 as a semiconductor switch.

The use of FET 1 comprised as described above to form a 3-way switch on a single semiconductor substrate is considered next below. As described above, this FET 1 has two connected transmission lines 5 and 7 formed on a single straight line. It is therefore possible to dispose one transmission line in line with the signal input direction, dispose the other two transmission lines at 90 degrees and 270 degrees to the signal input direction, to thereby assure an equal distance from the signal input terminal to each switch. Accordingly, it is also possible to form a 3-way switch with low, equal loss on each switching path.

Figure 6:
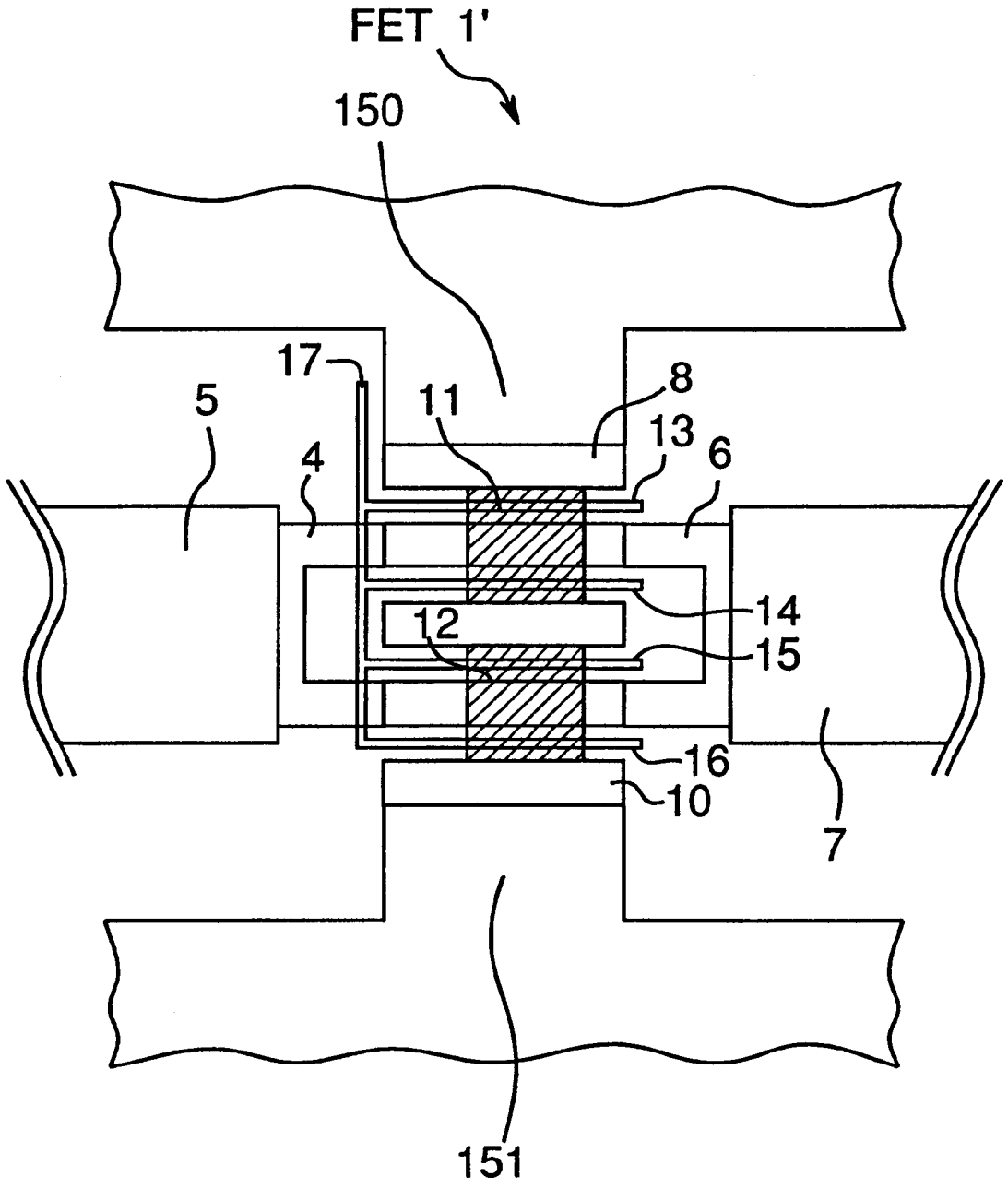
FIG. 6 is a typical plan view of the FET according to a second preferred embodiment of the present invention.

It will also be obvious to one with ordinary skill in the related art that the via holes 18 and 19 of the FET 1 shown in FIG. 1 can be replaced in a FET 1' as shown in FIG. 6 with ground plates 150 and 151 disposed on a surface of the substrate. In the case of FET 1' in FIG. 6, ground plate 150 is connected to source electrode 8, and ground plate 151 is connected to source electrode 10. The impedance $Z_{on}$ when FET 1' is on, and impedance $Z_{off}$ when it is off, can be expressed as shown in equations (1) to (3) and described above with reference to FET 1, and further description thereof is thus omitted below.

(2) First Alternative Version of the First Embodiment

Figure 7B:
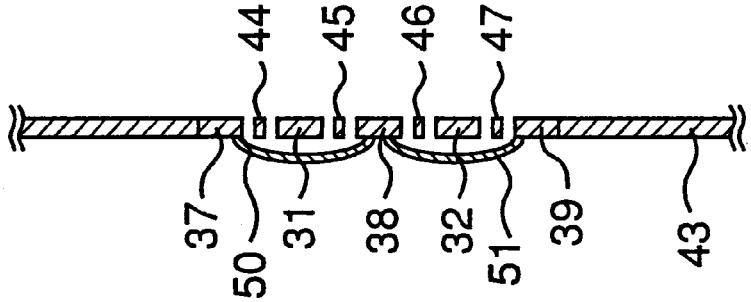
FIG. 7B is a section view taken along the line VIIB–VIIB' in FIG. 7A.
Figure 7A:
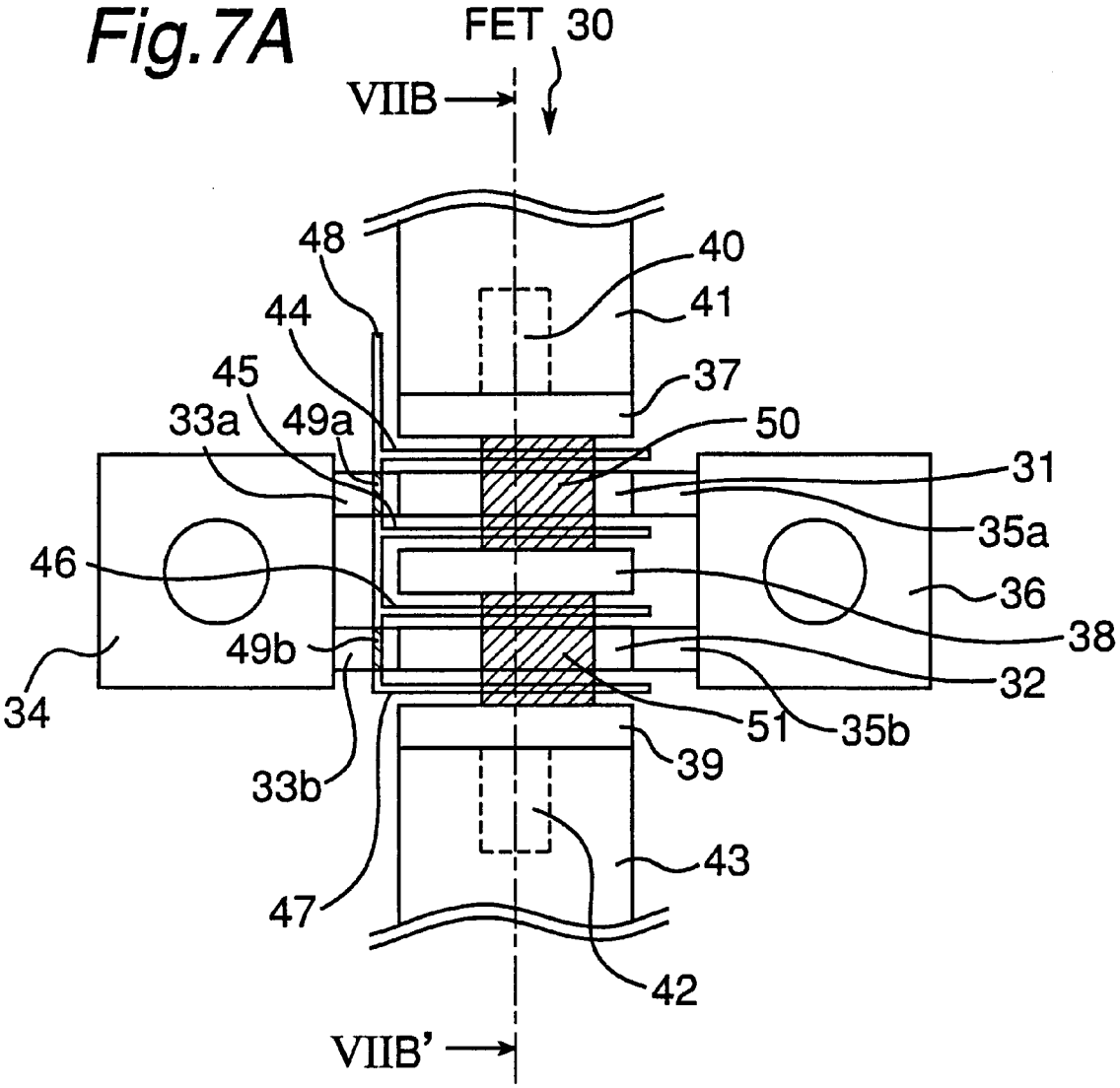
FIG. 7A is a typical plan view of the FET according to a first alternative version of the first preferred embodiment of the present invention.

FIG. 7A is a typical plan view of a FET 30 according to an alternative version of the FET 1 shown in FIG. 1 according to the present invention; and FIG. 7B is a section view through VIIB–VIIB' in FIG. 7A. FET 30 differs from FET 1 in that a via hole is connected to a drain electrode in FET 30, whereas the via holes are connected to the source electrodes in FET 1 as described above.

In the FET 30 as shown in FIG. 7 transmission lines 41 and 43 are disposed in a single straight line, and two via holes 34 and 36 are intersecting transmission lines 41 and 43.

The left ends of drain electrode prongs 31 and 32 as seen in the figure are connected by drain interconnect 33 to via hole 34. The right ends of drain electrode prongs 31 and 32 as seen in the figure are connected by drain interconnect 35 to via hole 36. Source electrode 37 and source electrode 38 are connected by a conductive air bridge 50 bridging gate electrode prongs 44 and 45 and drain electrode prong 31. Source electrode 38 and source electrode 39 are connected by a conductive air bridge 51 bridging gate electrode prongs 46 and 47 and drain electrode prong 32. Source electrodes 37 and 39 are each connected to a drain interconnect 40 and 42, respectively. Generally comb-shaped gate electrode prongs 44, 45, 46 and 47 are connected to gate current supply interconnect 48. This gate current supply interconnect 48 is isolated from the drain interconnect 33*a* and 33*b* where they cross at intersections 49*a* and 49*b* by an isolation layer therebetween.

The impedance $Z_{on}$ when FET 30 is on, and impedance $Z_{off}$ when it is off, can be expressed as shown in equations (1) to (3) and described above with reference to FET 1, and further description thereof is thus omitted below.

Figure 8:
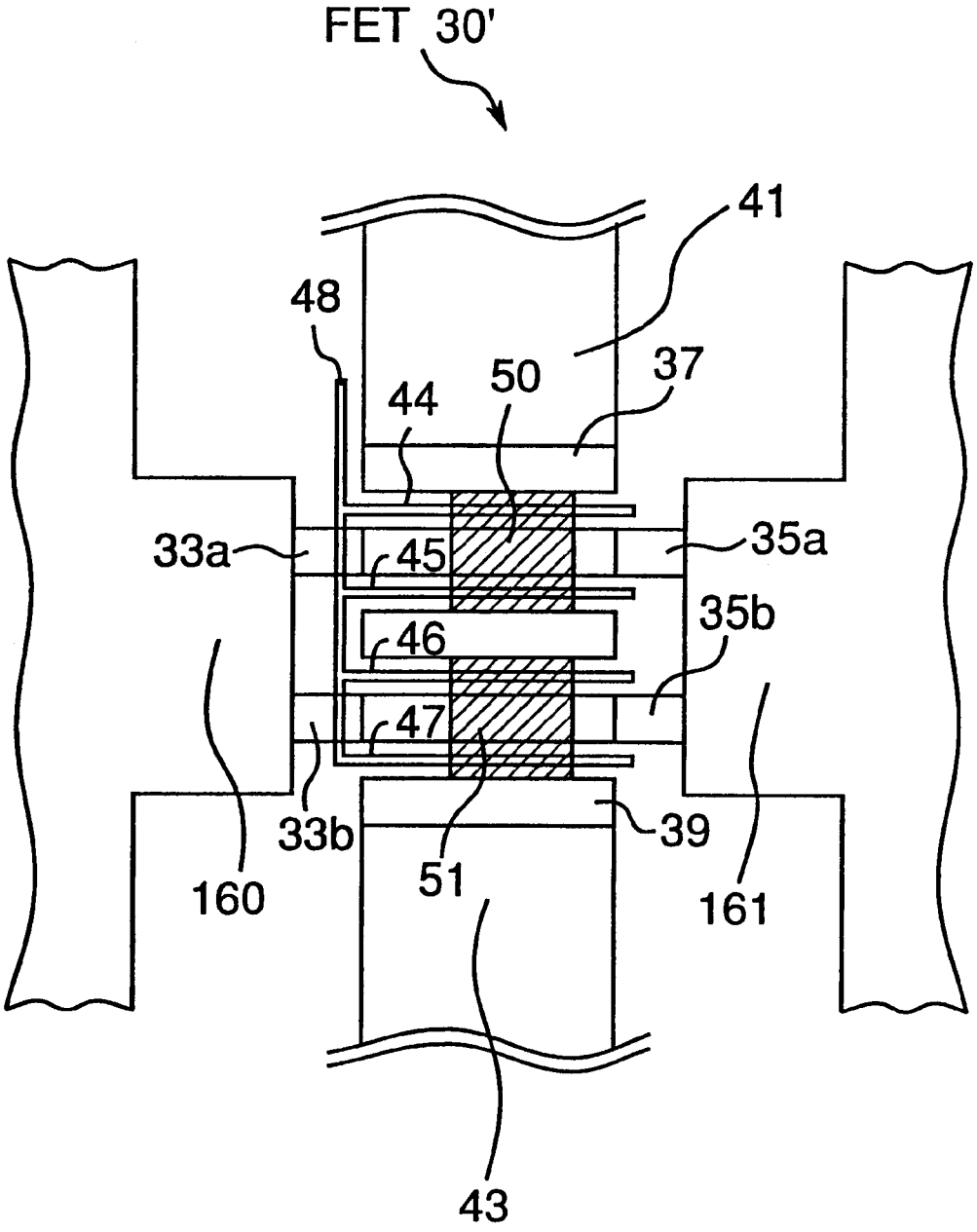
FIG. 8 is a typical plan view of the FET according to a second alternative version of the second preferred embodiment of the present invention.

It will also be obvious to one with ordinary skill in the related art that the via holes 34 and 36 of the FET 30 shown in FIG. 7 can be replaced in a FET 30' as shown in FIG. 8 with ground plates 160 and 161 disposed on a surface of the substrate. In the case of FET 30' in FIG. 8, ground plate 160 is connected to drain interconnect 33*a*, 33*b*, and ground plate 161 is connected to drain interconnect 35*a* and 35*b*. The impedance $Z_{on}$ when FET 30' is on, and impedance $Z_{off}$ when it is off, can be expressed as shown in equations (1) to (3) and described above with reference to FET 1, and further description thereof is thus omitted below.

(3) Embodiment 2

An FET 60 according to a second preferred embodiment of the present invention is characterized by having a via hole for directly grounding a source electrode disposed for each source electrode. This configuration makes it possible to further reduce the inductance Ls of each via hole at the on or off impedance $Z_{on}$ or $Z_{off}$. As a result, switching characteristics, that is, low loss and high isolation, can be further improved significantly.

Figure 9:
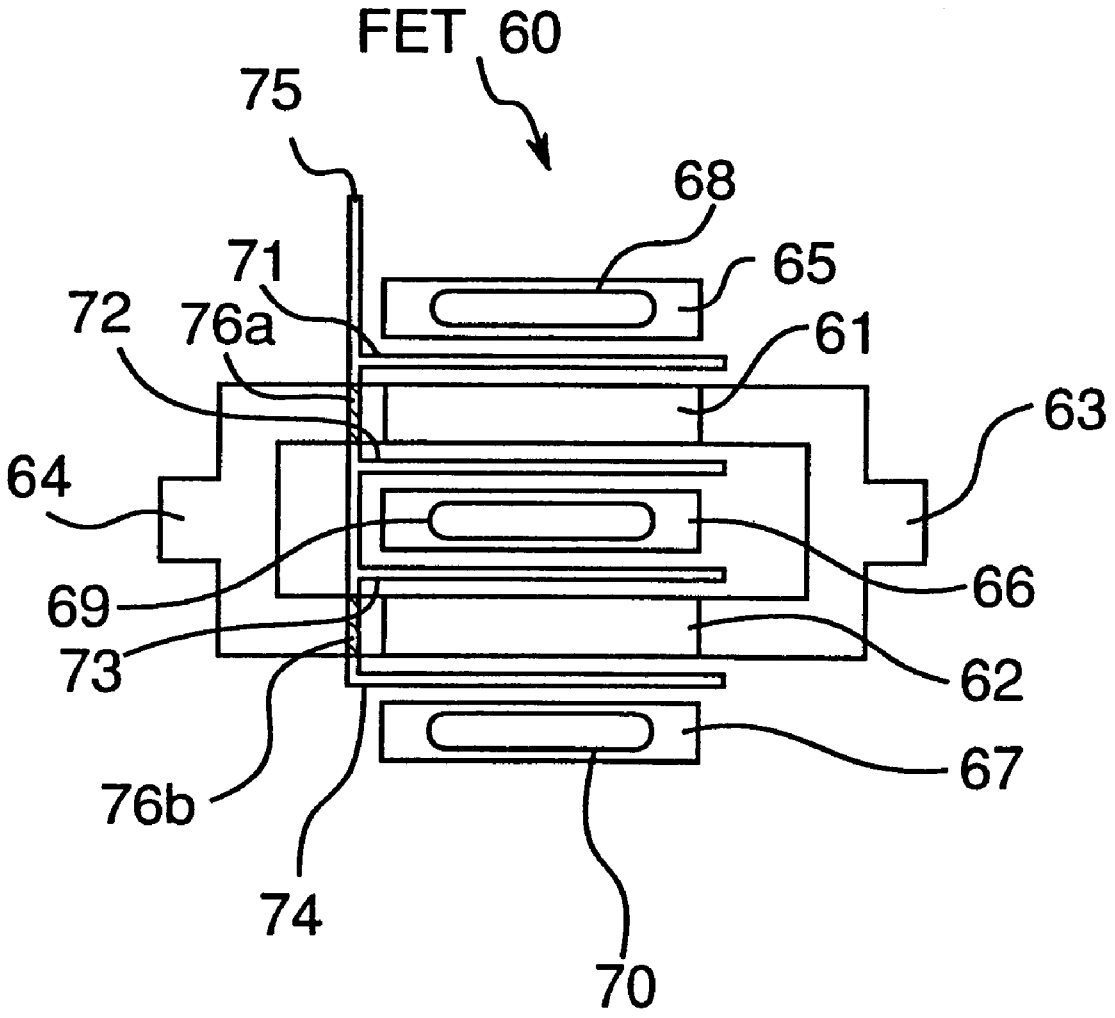
FIG. 9 is a typical plan view of the FET according to a third alternative version of the second preferred embodiment of the present invention.

FIG. 9 is a plan view of the FET 60 according to this second embodiment of the invention. Each source electrode 65, 66 and 67 has a via hole 68, 69 and 70, respectively, for connecting the associated source electrode directly to the ground layer of a semiconductor substrate (not shown). The right end of each drain electrode prong 61 and 62 as seen in the figure is connected to a drain interconnect 63. The left end of each drain electrode prong 61 and 62 as seen in the figure is connected to a drain interconnect 64. Gate electrode prongs 71, 72, 73 and 74 disposed between source and drain electrodes are connected to gate current supply interconnect 75. This gate current supply interconnect 75 is isolated from the drain interconnect 64 where they cross at intersections 76*a* and 76*b* by an insulator.

As compared with the FET 1 according to the first embodiment of the present invention, this FET 60 according to the second embodiment shortens the distance between a source electrode and via hole, and thereby further reduces the total inductance $Ls_{sum}$.

(4) First Variation of the Second Embodiment

Figure 10B:
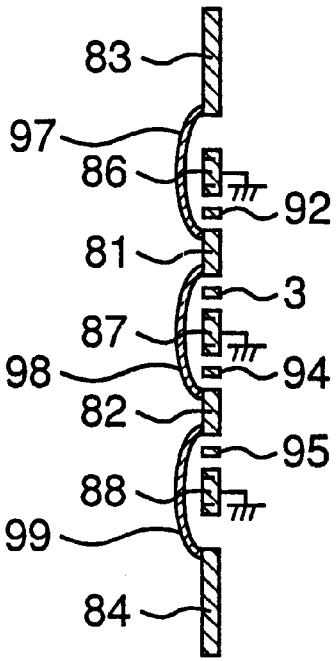
FIG. 10B is a section view taken along the line XB–XB' in FIG. 10A.
Figure 10A:
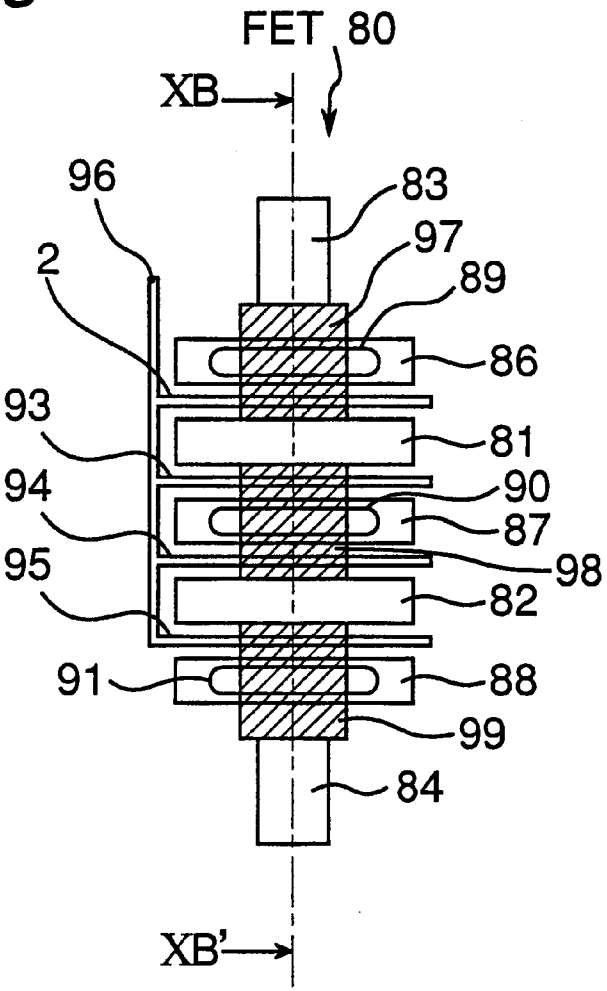
FIG. 10A is a typical plan view of the FET according to a fourth alternative version of the first preferred embodiment of the present invention.

FIG. 10A is a plan view of a first variation 80 of the FET according to the second preferred embodiment of the present invention, and FIG. 10B is a section view through line XB–XB' in FIG. 10A.

In this FET 80, each source electrode 86, 87 and 88 has a via hole 89, 90 and 91 connected to a ground layer of a semiconductor substrate. Drain interconnect 83 and drain electrode prong 81 are connected by a conductive air bridge 97 bridging source electrode 86 and gate electrode prong 92. Drain electrode prong 81 and drain electrode prong 82 are connected by a conductive air bridge 98 bridging gate electrode prongs 93 and 94 and source electrode 87. Drain electrode prong 82 and drain electrode prong 83 are connected by conductive air bridge 99 bridging gate electrode prong 95 and source electrode 88. Generally comb-shaped gate electrode prongs 92, 93, 94 and 95 are connected to gate current supply interconnect 96.

In the FET 80 thus comprised the gate current supply interconnect 96 does not cross any source or drain electrode, thereby further simplifying FET configuration.

As compared with FET 1, FET 1', FET 30 and FET 30', the FET 80 according to this embodiment of the invention yet shortens the source electrode to via hole distance, and can thereby further reduce the total inductance $Ls_{sum}$. That is, the FET 80 according to this exemplary embodiment further reduces the impedance $Z_{on}$ observed from drain interconnect 83, as well as increase the off state impedance $Z_{off}$. Switching characteristics can thus be further improved.

(5) Second Variation of the Second Embodiment

Figure 11:
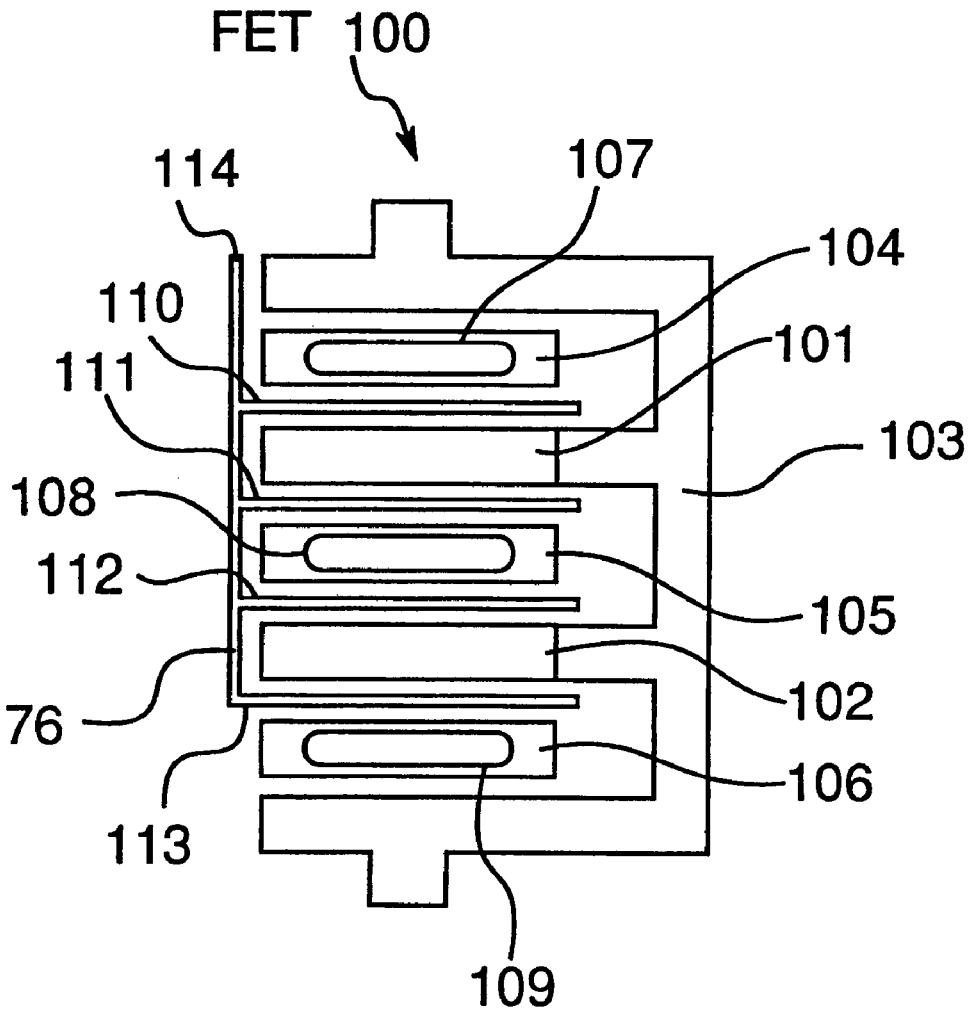
FIG. 11 is a typical plan view of the FET according to a second alternative version of the second preferred embodiment of the present invention.

FIG. 11 is a plan view of a FET 100 according to a second variation of the second preferred embodiment of the invention. In this FET 100, source electrodes 104, 105 and 106 each have a via hole connected to a ground conductor on the back of the substrate. Drain electrode prongs 101 and 102 are connected to a drain interconnect 103 at the right edge as seen in FIG. 11 so that they do not intersect source electrodes 104, 105, and 106.

As does the FET 80 shown in FIG. 10, the FET 100 according to this variation can further reduce the total inductance $Ls_{sum}$ between source electrodes and via holes. As a result, this FET 100 can suppress an increase in on-state impedance $Z_{on}$ and suppress a decrease in off-state impedance $Z_{off}$. As a result, switching characteristics can be further improved.

(6) Embodiment 3

Figure 12:
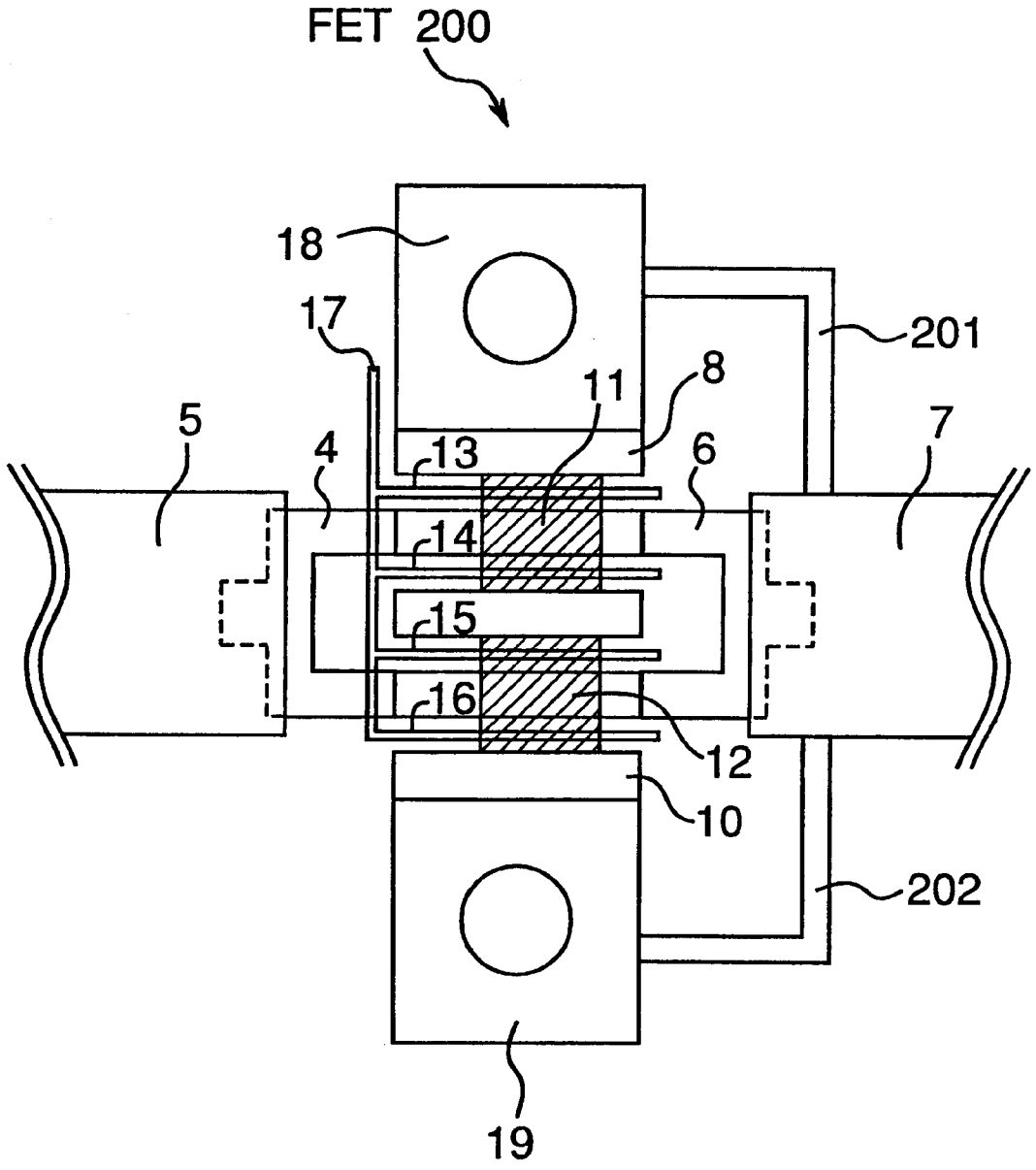
FIG. 12 is a typical plan view of the FET according to a third preferred embodiment of the present invention.

FIG. 12 is a plan view of a FET 200 according to a third embodiment of the present invention. This FET 200 differs from the FET 1 shown in FIG. 1 in the addition of resonance lines 201 and 202. Resonance line 201 has an inductance Lc, and connects via hole 18 and transmission line 7. Resonance line 202 has the same inductance Lc as resonance line 201 and connects via hole 19 and transmission line 7.

Figure 13:
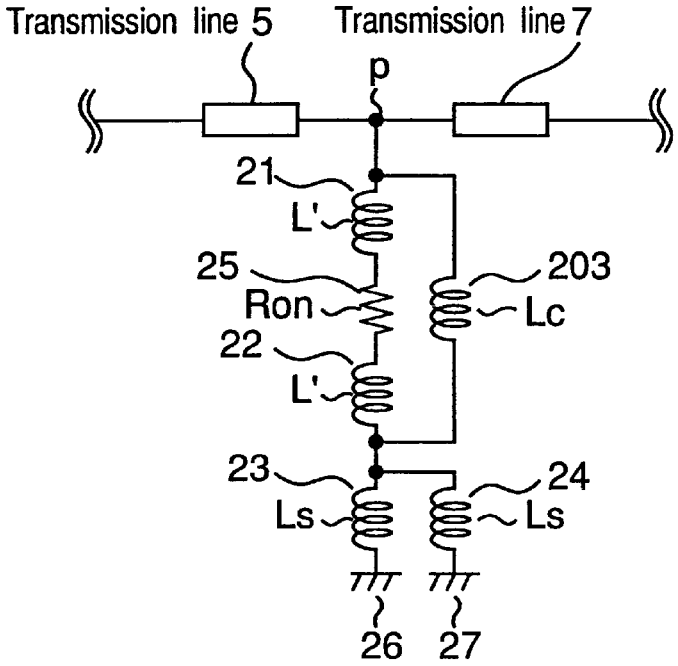
FIG. 13 is an equivalent circuit of the FET in FIG. 12 when the FET is in the ON state.

FIG. 13 is an equivalent circuit of this FET 200 used as a SPST switch in an MMIC device when a specific gate voltage Vg is applied to turn FET 200 on. Inductances 21 and 22 in FIG. 12 are the inductance component L' of the FET 200 design. Inductances 23 and 24 are the inductance components Ls of the via holes 18 and 19. Resistance 25 is the source-drain resistance $R_{on}$ in FET 200. When resistance $R_{on}$ is several ohms, the impedance $Z_{on}$ of FET 200 observed at node p can be obtained by the following equation 4.

$$Z_{on}=[1/(R_{on}+j2\pi f\cdot 2L)+1/(j2\pi f\cdot Lc)]^{-1}+Ls_{sum} \quad (4)$$

As will be known from equation (4), the impedance $Z_{on}$ increases in conjunction with an increase in the frequency f of the supplied RF signal.

Figure 14:
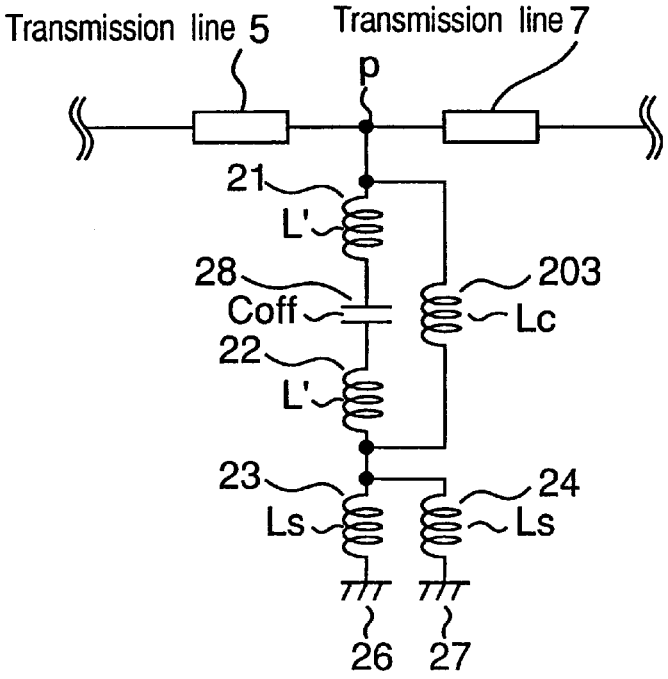
FIG. 14 is an equivalent circuit of the FET in FIG. 12 when the FET is in the OFF state.

FIG. 14 is an equivalent circuit of this FET 200 used as a SPST switch in an MMIC device when the voltage supplied to the gate current supply interconnect 17 is switched to a level below the drain current pinch-off voltage Vp of the FET 200 to turn the FET 200 off. Capacitance $C_{off}$ is the source-drain capacitance in FET 200. Impedance $Z_{off}$ of FET 200 observed from node a is as shown in equation (5).

$$Z_{off}=[\{j2\pi f(2L'+(1/Coff)\}^{-1}+1/j2\pi Lc]^{-1}+Ls_{sum}=j2\pi f(Lc-4\pi^2*2L'*Coff*Lc)/1-4\pi f^2\cdot 2L'\cdot Coff(2L'+Lc) \quad (5)$$

When L'<Lc, impedance $Z_{off}$ will be approximately equal to infinity if resonance lines 201 and 202 having inductance Lc satisfying equation (6) are used. It will then be possible to treat FET 200 as a substantially open terminal to an RF signal of frequency f, and an ideal switching characteristic, that is, high isolation, can be achieved.

$$4\pi^2 f^2\cdot Coff\cdot Lc=1 \quad (6)$$

Figure 15:
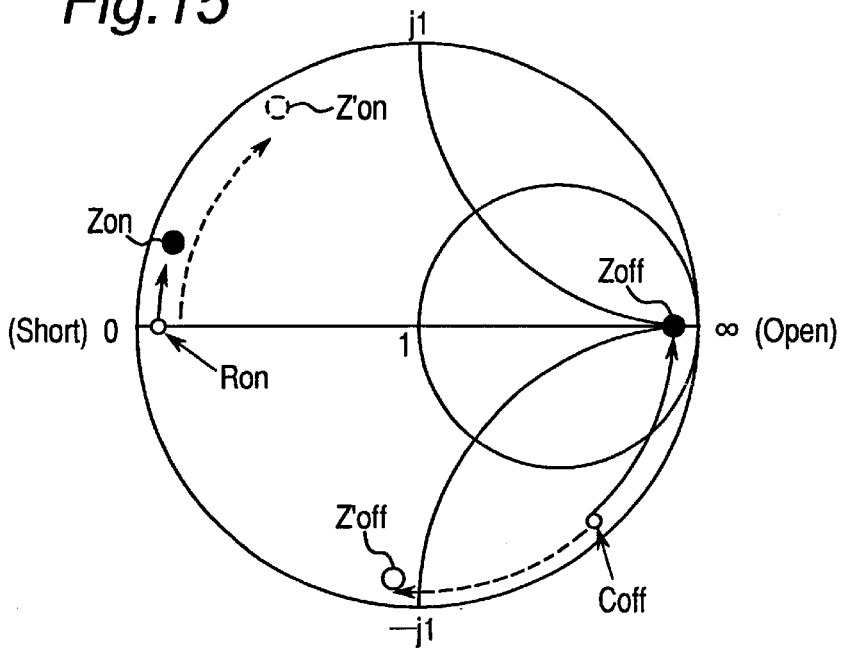
FIG. 15 is a Smith chart illustrating the performance of the FET of FIG. 12.

FIG. 15 is a Smith chart showing impedance $Z_{on}$ and impedance $Z_{off}$, indicated by the black dots in the figure, at node p [B, sic] in FIG. 13 and FIG. 14 when an RF signal of frequency f=75 GHz is passed. As will be known from the figure, FET 200 according to this exemplary embodiment can further reduce impedance $Z_{on}$ as compared with the FET 1 according to the first embodiment, and can increase impedance $Z_{off}$ to an effectively unlimited level. As a result, switching characteristics in an off state can be further improved.

(7) Variation of the Third Embodiment

Figure 16:
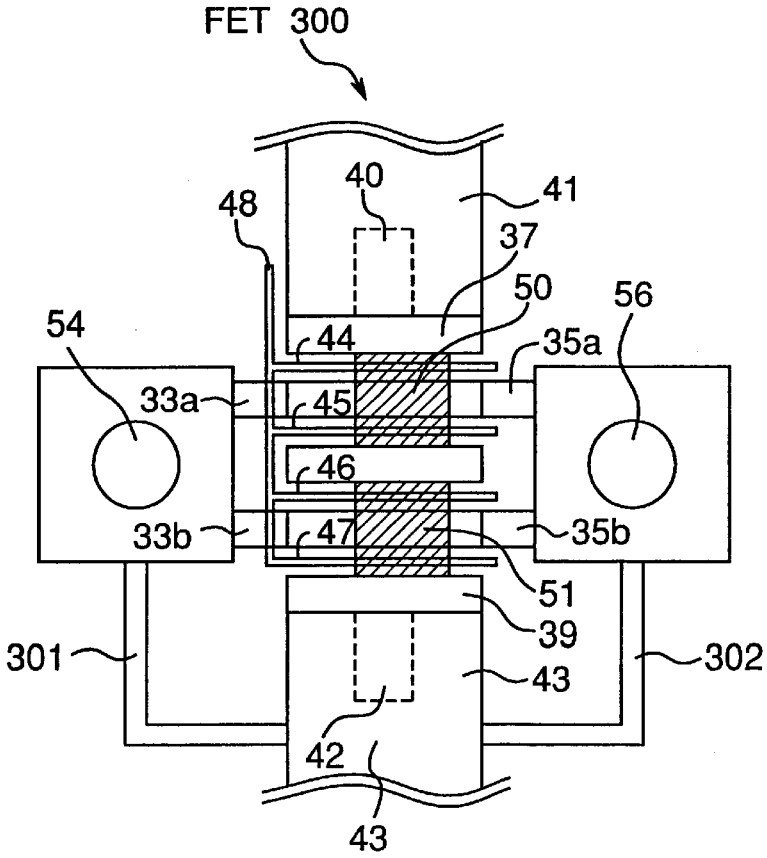
FIG. 16 is a variation of the third preferred embodiment.
Figure 17B:
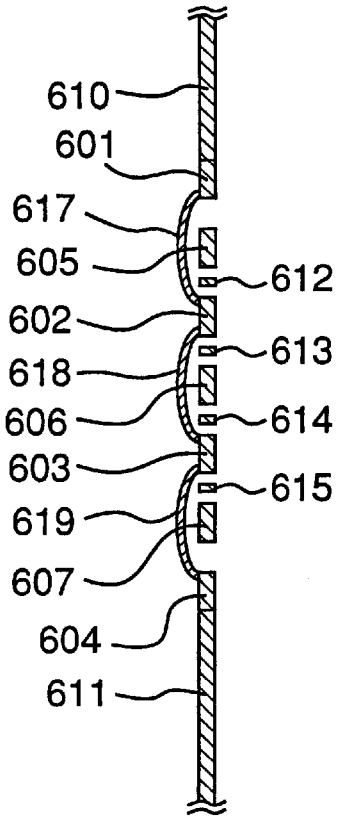
Fig.17B PRIOR ART
FIG. 17B is a section view taken along the line XVIIB–XVIIB' in FIG. 17A.
Figure 17A:
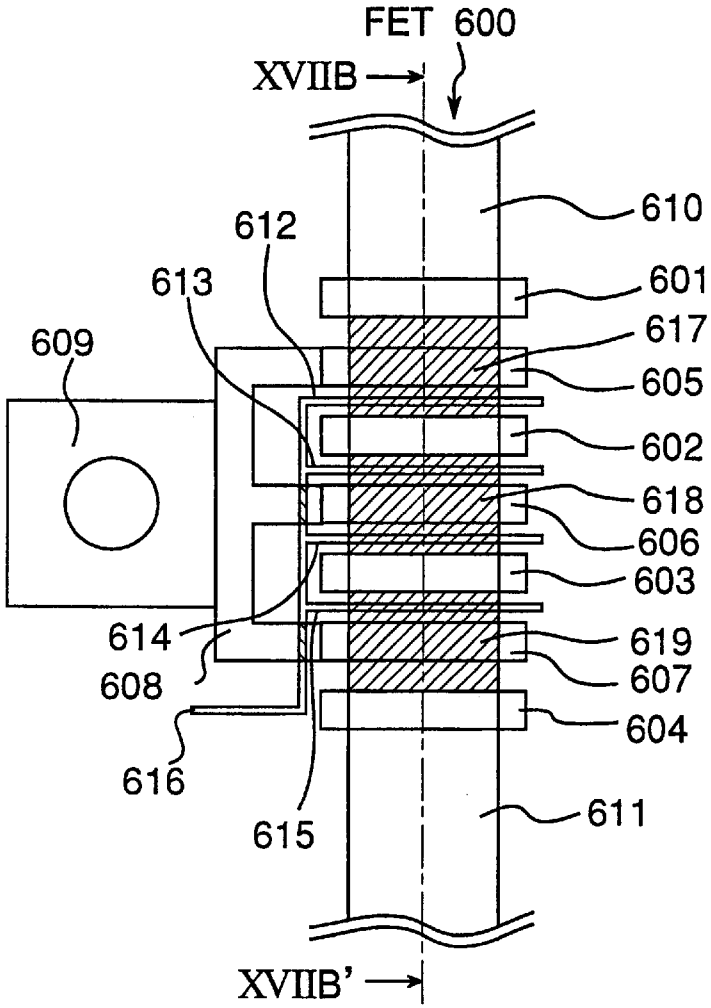
Fig.17A PRIOR ART
FIG. 17A is a typical plan view of the conventional FET.
Figure 18:
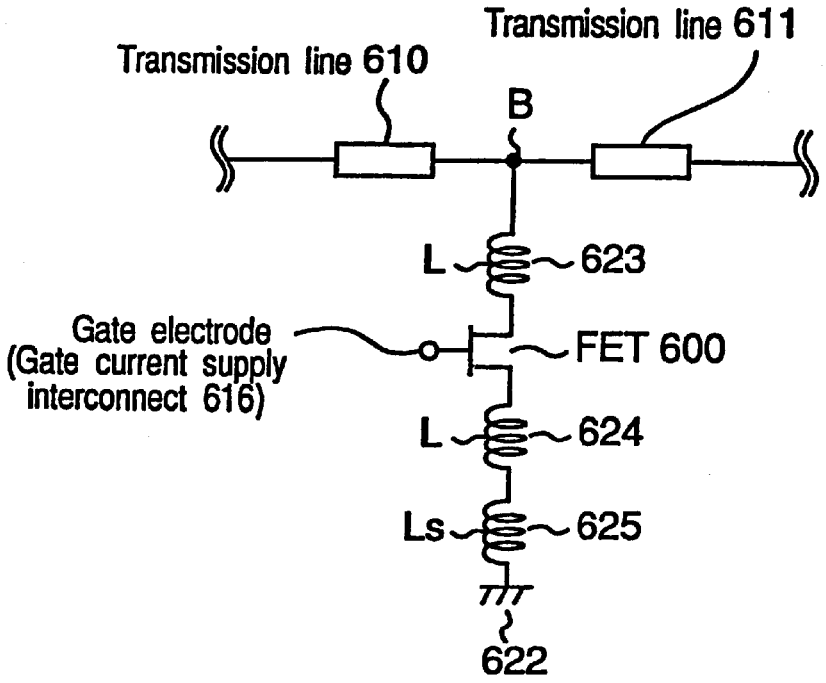
Fig.18 PRIOR ART
FIG. 18 is an equivalent circuit of the FET in FIG. 17A.
Figure 19:
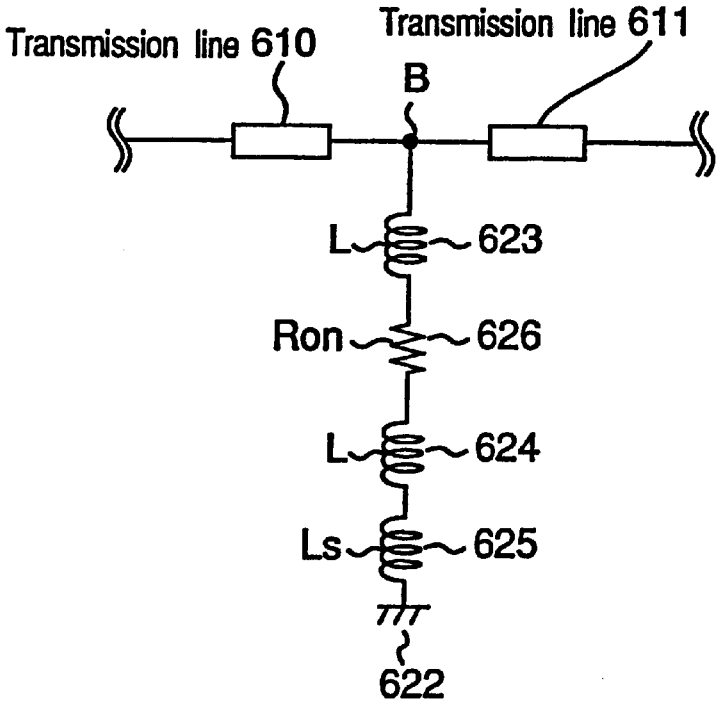
Fig.19 PRIOR ART
FIG. 19 is an equivalent circuit of the FET in FIG. 17A when the FET is in the ON state.
Figure 20:
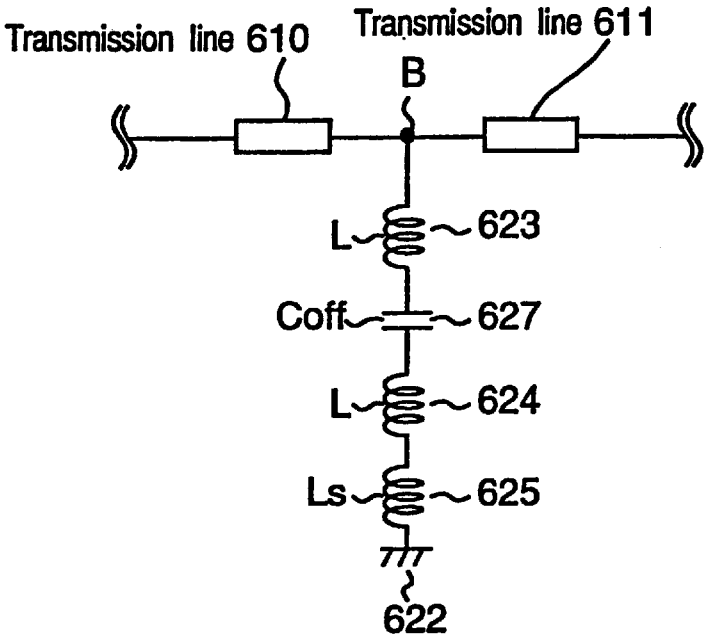
Fig.20 PRIOR ART
FIG. 20 is an equivalent circuit of the FET in FIG. 17A when the FET is in the OFF state.
Figure 21:
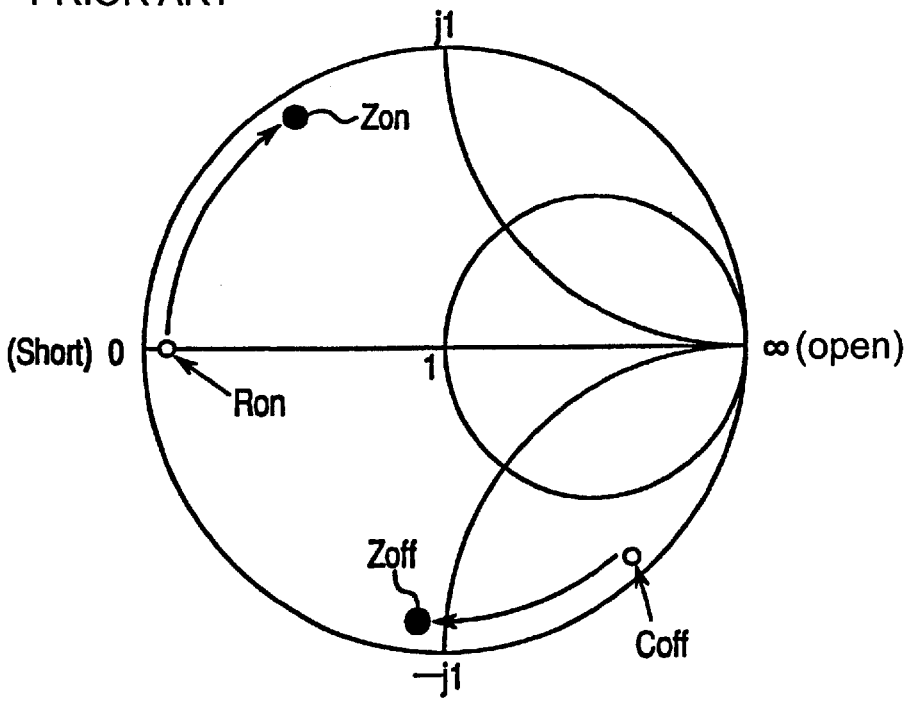
Fig.21 PRIOR ART
FIG. 21 is a Smith chart illustrating the performance of the FET of FIG. 17A.

FIG. 16 is a plan view of a FET 300 according to an alternative version of this third embodiment of the invention. This FET 300 differs from FET 30 shown in FIG. 7 in that via hole 54 and transmission line 43 are connected by a resonance line 301 having an inductance Lc, and via hole 56 and transmission line 43 are connected by a resonance line 302 having the same inductance Lc as resonance line 301.

The on-state impedance $Z_{on}$ and off-state impedance $Z_{off}$ of this FET 300 can also be derived from equations (4) to (6) described above with respect to the FET 200 shown in FIG. 12, and further description thereof is thus omitted below.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A millimeter-band semiconductor switching circuit having:

a field effect transistor (FET) as a switching element;

a millimeter-band transmission line lying along a connection direction and having two parts; and a ground having two ground connections, the FET being disposed between the two parts of the millimeter-band transmission line and the two ground connections and comprising:

a generally comb-shaped gate electrode having a plurality of gate electrode prongs and connected to a current supply path;

a plurality of first electrodes and second electrodes arrayed in alternating sequence with the plurality of gate electrode prongs, a gate electrode prong being disposed between each pair of first and second electrodes, and, each first electrode being disposed between a respective pair of the gate electrode prongs, at an interval;

a first electrode interconnect interconnecting the plurality of first electrodes at each of two opposite lengthwise ends of the first electrodes to the two ground connections at opposite sides of the FET transverse to the connection direction; and a second electrode interconnect including an air bridge interconnecting the plurality of second electrodes, wherein the two parts of the millimeter-band transmission line are respectively connected to the second electrode interconnect at opposite sides of the FET in the connection direction.

2. The millimeter-band semiconductor switching circuit according to claim 1, wherein the first electrodes comprise a drain electrode of the FET, and the second electrodes comprise a source electrode of the FET.

3. The millimeter-band semiconductor switching circuit according to claim 1, wherein the first electrodes comprise a source electrode of the FET, and the second electrodes comprise a drain electrode of the FET.

4. The millimeter-band semiconductor switching circuit according to claim 1, including via holes wherein the ground line is connected to ground by the via holes.

5. The millimeter-band semiconductor switching circuit according to claim 1, including a ground plate wherein the ground line is connected to ground by the ground plate.

6. The millimeter-band semiconductor switching circuit according to claim 1, including a resonance circuit having a specific reactance wherein the first electrode interconnect and the second electrode interconnect are mutually connected by means of the resonance circuit.

7. A millimeter-band semiconductor switching circuit having:

a field effect transistor (FET) as a switching element;

a ground; and a millimeter-band transmission line having two parts, the FET being disposed between the two parts of the millimeter-band transmission line and comprising:

a generally comb-shaped gate electrode having a plurality of gate electrode prongs and connected to a current supply path;

a plurality of first electrodes and second electrodes arrayed in alternating sequence with a plurality of gate electrode prongs, a gate electrode prong being disposed between each pair of first and second electrodes, and each second electrode being disposed between a respective pair of the gate electrode prongs with a gap from the gate electrode prongs;

ground connections directly connecting to the ground each of the plurality of first electrodes; and an electrode interconnect interconnecting the plurality of second electrodes, and respectively connected at opposite sides of the FET to the two parts of the transmission line.

8. The millimeter-band semiconductor switching circuit according to claim 7, wherein the electrode interconnect is connected to each second electrode in a lengthwise direction of the second electrodes, and has transmission line connecting terminals at opposite sides of the FET in the lengthwise direction of the second electrodes, respectively connected to the two parts of the transmission line.

9. The millimeter-band semiconductor switching circuit according to claim 7, wherein the electrode interconnect includes an air bridge connecting adjacent second electrodes in a widthwise direction of the second electrodes, and transmission line connecting terminals at opposite sides of the FET in a widthwise direction of the second electrodes, respectively connected to the two parts of the transmission line.

10. The millimeter-band semiconductor switching circuit according to claim 7, wherein the electrode interconnect is interleaved with the plurality of second electrodes, and including transmission line connecting terminals at opposite sides of the FET and the second electrodes.

11. The millimeter-band semiconductor switching circuit according to claim 7, wherein the ground connections comprise respective via holes in each of the first electrodes directly connecting the respective first electrodes to the ground.

12. A millimeter-band semiconductor switching circuit having:

a field effect transistor (FET) as a switching element;

a millimeter-band transmission line lying along a connection direction and having two parts; and a ground having two ground connections, the FET being disposed between the two parts of the millimeter-band transmission line and the two ground connections and comprising:

a generally comb-shaped gate electrode having a plurality of gate electrode prongs and connected to a current supply path;

a plurality of first electrodes and second electrodes arrayed in alternating sequence with the plurality of gate electrode prongs, a gate electrode prong being disposed between each pair of first and second electrodes, and each first electrode being disposed between a respective pair of the gate electrode prongs at an interval;

a first electrode interconnect interconnecting the plurality of first electrodes at each of two opposite lengthwise ends of the first electrodes; and a second electrode interconnect including an air bridge interconnecting the plurality of second electrodes, wherein the second electrode interconnect connects the second electrodes to the two ground connections at opposite sides of the FET transverse to the connection direction, and the two parts of the millimeter-band transmission line are respectively connected to the first electrode interconnect at opposite sides of the FET in the connection direction.

13. The millimeter-band semiconductor switching circuit according to claim 12, wherein the first electrodes comprise a drain electrode of the FET, and the second electrodes comprise a source electrode of the FET.

14. The millimeter-band semiconductor switching circuit according to claim 12, wherein the first electrodes comprise a source electrode of the FET, and the second electrodes comprise a drain electrode of the FET.

15. The millimeter-band semiconductor switching circuit according to claim 12, including via holes wherein the ground line is connected to ground by the via holes.

16. The millimeter-band semiconductor switching circuit according to claim 12, including a ground plate wherein the ground line is connected to ground by the ground plate.

17. The millimeter-band semiconductor switching circuit according to claim 12, including a resonance circuit having a specific reactance wherein the first electrode interconnect and the second electrode interconnect are mutually connected by means of the resonance circuit.

* * * * *